US008757596B2

(12) United States Patent
Jensen

(10) Patent No.: US 8,757,596 B2
(45) Date of Patent: Jun. 24, 2014

(54) GUARD RAIL INCLUDING NOISE-REDUCING MEASURES

(76) Inventor: Thomas Willum Jensen, Værløse (DK)

( * ) Notice: Subject to any disclaimer, the term of this patent is extended or adjusted under 35 U.S.C. 154(b) by 86 days.

(21) Appl. No.: 13/054,586

(22) PCT Filed: Jul. 2, 2009

(86) PCT No.: PCT/EP2009/058340

§ 371 (c)(1),
(2), (4) Date: Jan. 18, 2011

(87) PCT Pub. No.: WO2010/018028

PCT Pub. Date: Feb. 18, 2010

(65) Prior Publication Data

US 2011/0114909 A1 May 19, 2011

(30) Foreign Application Priority Data

Aug. 12, 2008 (DK) ..... 2008 01085

(51) Int. Cl.
*E01F 15/04* (2006.01)

(52) U.S. Cl.
USPC ..... 256/13.1

(58) Field of Classification Search
USPC ..... 256/13.1; 181/284, 290, 294
See application file for complete search history.

(56) References Cited

U.S. PATENT DOCUMENTS

| | | | | |
|---|---|---|---|---|
| 2,536,760 | A | 1/1951 | Martin et al. | |
| 3,846,949 | A | 11/1974 | Okawa | |
| 3,983,956 | A * | 10/1976 | Manhart | 256/13.1 |
| 4,423,854 | A * | 1/1984 | Cobb et al. | 256/13.1 |
| 4,566,558 | A * | 1/1986 | Link et al. | 180/290 |
| 4,638,979 | A * | 1/1987 | Demarest | 256/13.1 |
| 4,674,593 | A * | 6/1987 | McCarty | 181/290 |
| 5,942,736 | A * | 8/1999 | Cortonesi | 181/289 |
| 6,142,452 | A | 11/2000 | Denman et al. | |
| 7,220,077 | B2 * | 5/2007 | Humphries et al. | 404/6 |

FOREIGN PATENT DOCUMENTS

| | | | |
|---|---|---|---|
| CN | 2454408 | Y | 10/2001 |
| EP | 1 184 515 | A1 | 3/2002 |
| EP | 1 528 158 | A1 | 5/2005 |
| FR | 2 690 000 | A1 | 10/1993 |
| JP | 9-125321 | A | 5/1997 |
| JP | 10-338913 | A | 12/1998 |
| JP | 2007-218084 | A | 8/2007 |

OTHER PUBLICATIONS

International Search Report for International Application No. PCT/EP2009/058340, with a mailing date of Oct. 15, 2009, four (4) pages.

* cited by examiner

*Primary Examiner* — Michael P Ferguson

(74) *Attorney, Agent, or Firm* — Nath, Goldberg & Meyer; Jerald L. Meyer

(57) ABSTRACT

A guard rail is provided with noise-reducing measures and includes a plurality of substantially vertical posts supporting a longitudinal guard rail beam. Furthermore the guard rail is provided with plate-shaped noise-reducing modules attached to the supporting, substantially vertical posts. Advantageously, the guard rail may be perforated so that the sound is allowed to pass into the noise-reducing modules at the rear.

12 Claims, 4 Drawing Sheets

GUARD RAIL INCLUDING NOISE-REDUCING MEASURES

This is a National Phase Application filed under 35 USC 371 of International Application No. PCT/EP2009/058340, filed on Jul. 2, 2009, an application claiming foreign priority benefits under 35 USC 119 of Danish Application No. PA 2008 01085, filed on Aug. 12, 2008, the content of each of which is hereby incorporated by reference in its entirety.

TECHNICAL FIELD

The disclosed subject matter relates generally to a guard rail having noise-reducing measures.

BACKGROUND

A guard rail is a structure provided along a road section and with the object of limiting personal injuries by catching, slowing down or turning away vehicles veering off the roadway unintentionally. Guard rails can be categorized as road guard rails provided along a road usually on the verge (possibly on the centre strip), or as bridge guard rails mounted along the verge of a bridge or another structure. The guard rail may be a steel guard rail, the beam and the vertical posts of which are made from sectional steel.

Along busy roads in built-up areas it is furthermore commonly known to provide noise-reducing measures such as embankments, concrete walls or wall shaped structures for keeping down traffic noise, such as known from JP2007218084A, JP10338913A and EP1528158A1.

BRIEF SUMMARY

An aspect of the disclosed subject matter is to provide a guard rail with noise-reducing measures and which can be manufactured as an attractive economic alternative to the known structures.

The noise-reducing features of the structure are improved distinctively by the guard rail beam being perforated thus allowing the sound to pass into the noise-reducing modules provided at the rear and by the top plate reflecting the sound to the noise absorbent modules.

By making use of the steel guard rail normally being placed along the verge of the road close to the roadway, the height of the plate-shaped noise-reducing modules may be lower than twice the height from the bed to the top of the guard rail beam—and often they may be of the same height as said guard rail beam. This is can be done as road noise arises from three sources:

1. Engine noise which is normally reduced by exhaust silencers;
2. Signal noise arising from hooters and the like; and
3. Tyre noise resulting from the contact between the tyre and the roadway.

As especially the last-mentioned source of noise creates a nuisance on long, straight road sections at normal, steady speed, the sound barrier may advantageously be provided close to the source of noise, and thus a considerable muffling can be achieved without scarring the surroundings with a tall wall. Furthermore, it is advantageous that a considerable part of the noise is spread along the ground level and thrown back hereby.

The plate-shaped noise-reducing modules may advantageously include a mineral wool plate sheathed with a stiff metal net.

The disclosed subject matter may advantageously be applied in connection with a double-sided guard rail including two substantially parallel and opposite oriented guard rail beams. Thus the noise-reducing modules are provided between the noise-reducing beams and absorb the sound energy in the immediate vicinity (preferably less than 4 meters) of the primary source of noise—the contact between the tyre and the roadway.

Furthermore the disclosed subject matter relates to a road system including at least one roadway, a guard rail according to any one of claims 1 to 9 being provided along said roadway.

By attaching the plate-shaped noise-reducing modules to the supporting, substantially vertical posts it is possible to absorb the noise energy in the immediate vicinity of the primary source of noise—the contact between the tyre and the roadway. The guard rail is provided along and in the immediate vicinity of the roadway, and in a preferred embodiment it is provided as a separation between two opposite oriented roadways.

BRIEF DESCRIPTION OF THE DRAWING(S)

Below the disclosed subject matter is explained in detail in connection to preferred embodiments and with reference to the drawings, in which FIG. 1 is a diagrammatic view of a preferred embodiment of a single-sided guard rail including noise-reducing elements according to the disclosed subject matter.

DETAILED DESCRIPTION

Figure 1:
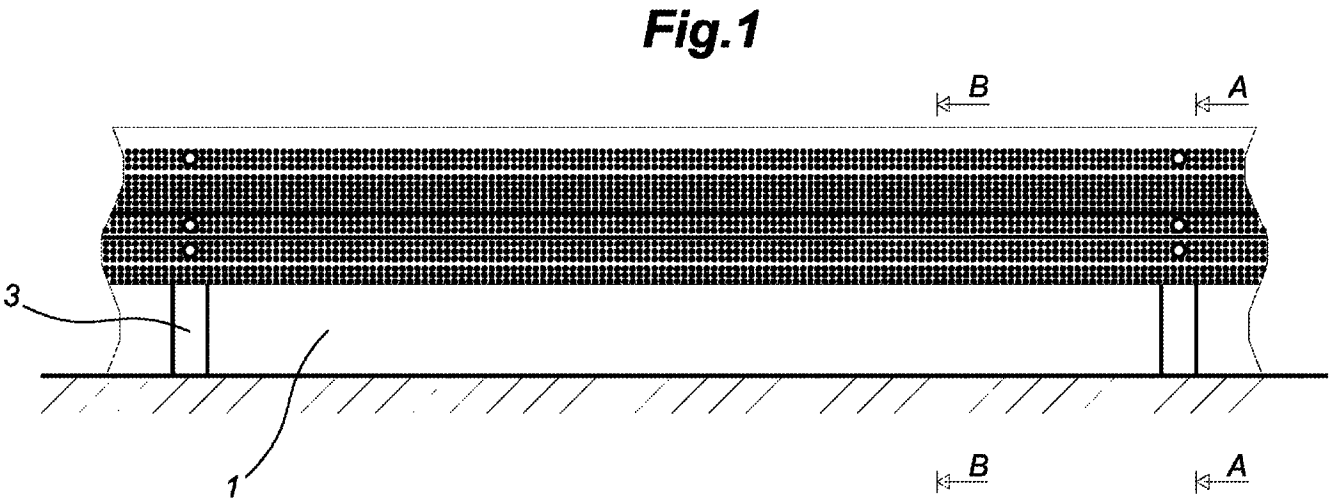
Figure 2:
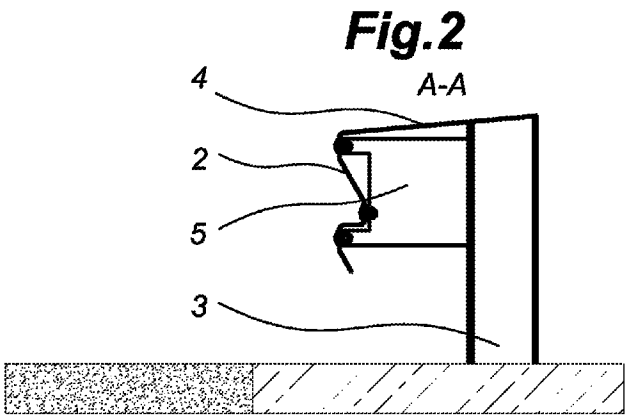
FIG. 2 shows a cross-section of the guard rail shown in FIG. 1 along the line A-A.
Figure 3:
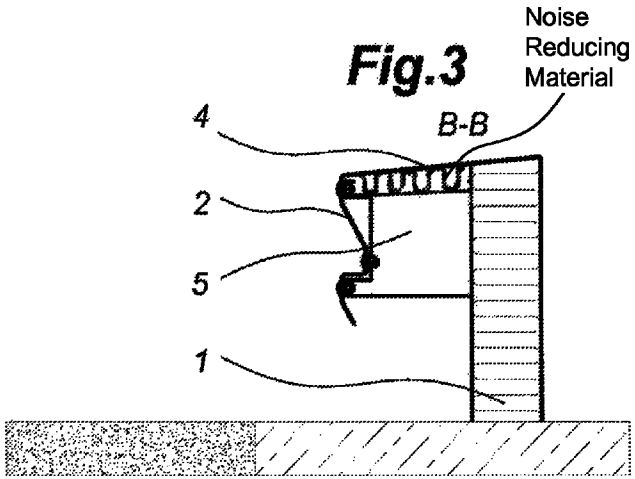
FIG. 3 shows a cross-section of the guard rail shown in FIG. 1 along the line B-B.

FIGS. 1-3 show a preferred embodiment of a single-sided guard rail including noise-reducing elements according to the disclosed subject matter. The guard rail is constructed as a steel guard rail including a plurality of posts 3 provided at a predetermined distance and supporting the guard rail, which is anchored into the ground, gravel or concrete. Advantageously, the posts 3 often may have an H-profile. It is not shown in the Figures, but conventionally the guard rail has a starting point and/or an ending point with a gradual adjustment of the height of the guard rail from its full height to zero—i.e. a decline in the guard rail. The disclosed subject matter is particularly applied at sections at full height.

Conventionally, a supporting arm 5 manufactured from steel and having a U-shape is attached to the posts 3, the extremities of said supporting arm 5 being secured with bolts or welded to one of the posts 3. A guard rail beam 2 is secured with bolts to the supporting arm 5. As a single-sided guard rail is constructed to work on collision solely from one side, a person skilled in the art can understand that securing the guard rail beams 2 ensures that they may be prolonged slightly and ensure that the guard rail is not broken through in case of an accident, the deformability of the supporting arms 5 absorbing the energy from a vehicle in case of a collision.

In an preferred embodiment the guard rail beam 2 is connected to a top plate 4. In another embodiment the guard rail beam 2 and the top plate 4 may be two separate sectional plates.

A noise-reducing plate 1 absorbing the noise from passing traffic is provided between, in front of or behind the posts 3.

Advantageously, the noise-reducing plate 1 may have a mineral wool core sheathed with a steel wire netting or a perforated plate—possibly with a metal frame along the edge; thus said metal frame may be used to fasten the plate 1 to the posts 3. In the preferred embodiment the plate 1 has a height fitting the height of the guard rail.

Alternatively, the plate 1 may be placed in front of the post 3 or behind the post 3. Alternatively, the plate 1 may have a core of polymer material.

In an embodiment of the disclosed subject matter a considerable part of the guard rail beam 2 is provided with perforations—e.g. punched perforations having a diameter of 3 mm at a centre distance of 6 mm. Hereby the acoustic qualities of the beam ensure that the sound passes into the noise-reducing plate 1 at the rear instead of being reflected. Advantageously, the perforations may be punched before the plate is pressed to the final form of the guard rail beam 2.

Provided that the guard rail is placed far from the source of noise, it may in some connections be appropriate to heighten the posts 3, so that an additional noise-reducing plate 1 is fastened above the guard rail 2, the noise-reducing measure thus obtaining twice the height of the guard rail.

Figure 4:
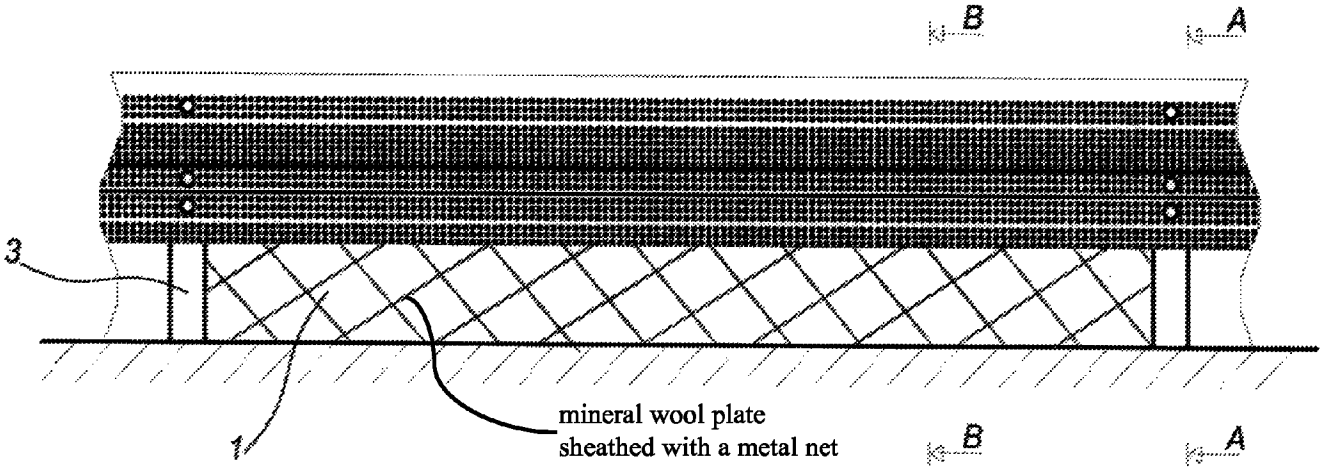
FIG. 4 is a diagrammatic view of a preferred embodiment of a double-sided guard rail with noise-reducing elements according to the disclosed subject matter.
Figure 6:
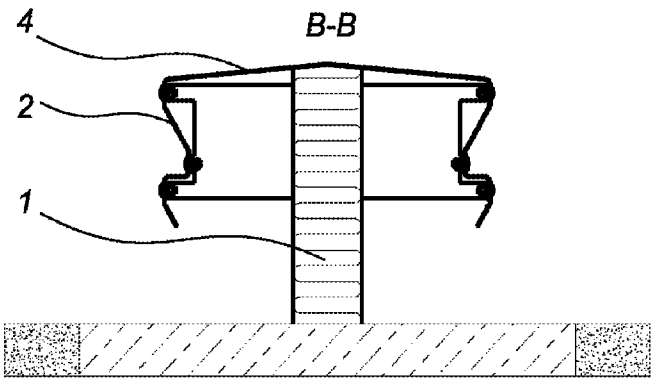
FIG. 6 shows a cross-section of the guard rail shown in FIG. 1 along the line B-B.
Figure 5:
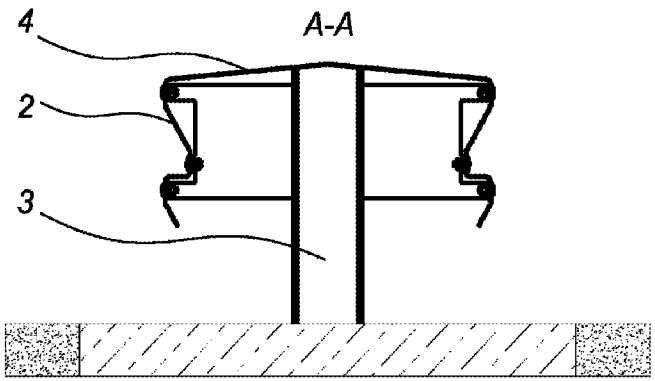
FIG. 5 shows a cross-section of the guard rail shown in FIG. 1 along the line A-A.

FIGS. 4-6 show a double-sided guard rail constructed to work in case of collisions from both sides. The functioning is the same as with the single-sided guard rail explained with reference to FIGS. 1-3., but said double-sided guard rail has two substantially parallel and opposite oriented guard rail beams 2 and noise-reducing plates 1 provided in between the guard rail beams 2.

Figure 7:
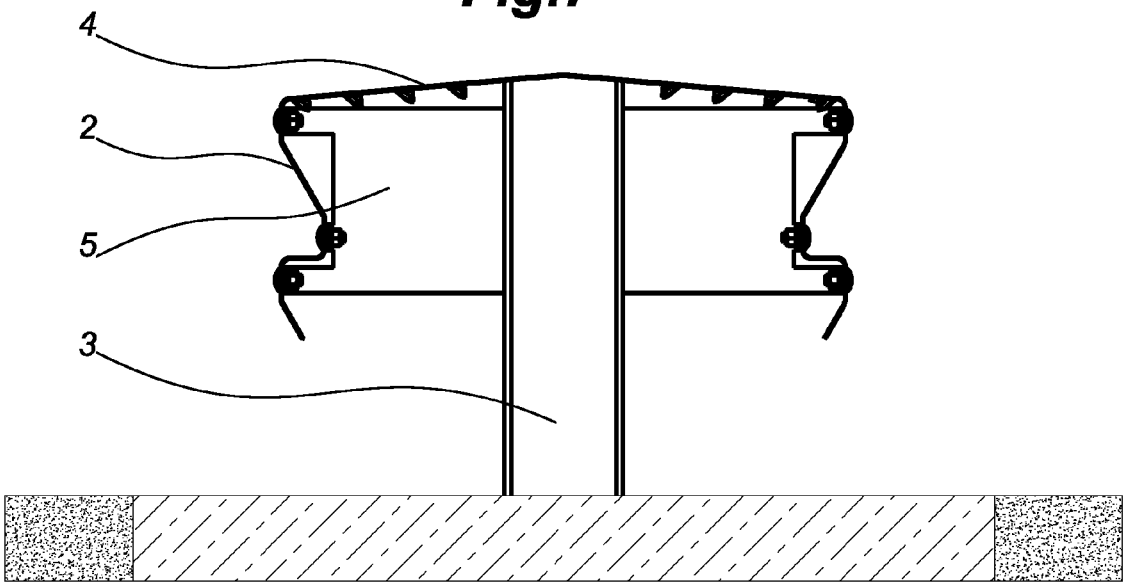
FIG. 7 shows an alternative embodiment of the guard rail shown in FIG. 4 as a cross-section equal to FIG. 5.
Figure 8:
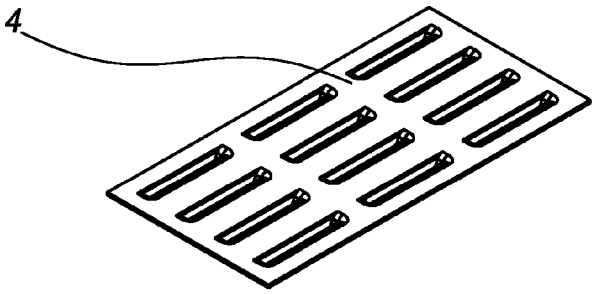
FIG. 8 is a perspective view of an embodiment of a top plate for the guard rail shown in FIG. 7.

FIGS. 7 and 8 show an alternative embodiment having perforations in the top plate 4, the punched perforations being long so that the top plate substantially has the characteristics of a grating.

Thus the disclosed subject matter relates to a noise-reducing guard rail combining a wall 1 of noise absorbing material, a top plate 4 as well as a guard rail beam 2. The top plate 4 functions as a part of the guard rail and reflects noise which would escape between the noise wall 1 and the guard rail beam 2, if said top plate 4 was not provided. The noise is reflected back to the noise absorbing wall 1.

The disclosed subject matter may be applied along all known roadways along which a guard rail is desirable or required. Furthermore, the noise-reducing guard rail functions as a traditional guard rail and shall also reduce traffic noise. The top plate may have a noise-reducing material at the underside. The guard rail beam may be reinforced by longitudinal steel wires.

Figure 9:
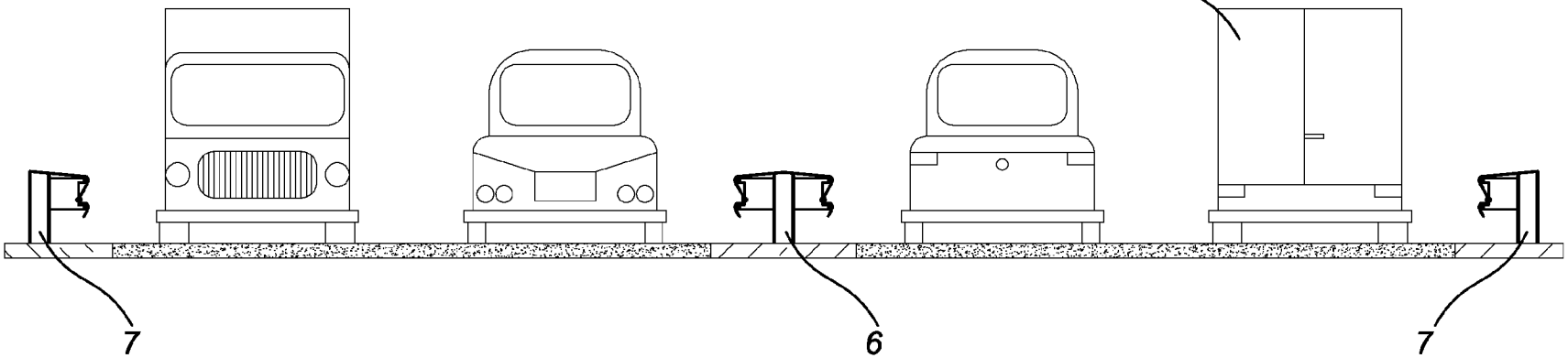
FIG. 9 shows a road system including both a single-sided and a double-sided guard rail according to the disclosed subject matter.

FIG. 9 shows a roadway with two lanes in each direction. Along the roadside single-sided guard rails 7 are provided of the kind explained with reference to FIGS. 1-3, and the opposite oriented lanes are separated by a centre strip along which a double-sided guard rail 6 is provided of the kind explained with reference to FIGS. 4-6. Hereby the noise from traffic 8 at large approach roads may be reduced substantially without a town being intersected by an unsightly barrier.

The invention claimed is:

1. A guard rail having noise-reducing measures comprising:

a plurality of substantially vertical posts (3);

a longitudinal guard rail beam (2) supported by the plurality of substantially vertical post through arms attached to the posts; and a noise-absorbing plate (1) attached to and longitudinally extending between each adjacent pair of the plurality of substantially vertical posts (3) at a rear of the longitudinal guard rail beam and extending substantially the entire height of the vertical posts, the noise-absorbing plate comprising a core of noise-absorbing material, wherein the longitudinal guard rail beam (2) comprises perforations and sound passes through the perforations into the noise-absorbing plate (1), and wherein the noise-reducing measures further comprises a top plate (4) extending substantially the entire length of the longitudinal guard rail beam from the longitudinal guard rail beam to the noise-absorbing plate (1), the top plate being coupled to the longitudinal guard rail beam and the vertical posts, and extending above and covering the arms, the posts and the noise-absorbing plate, and wherein the top plate (4) is provided with perforations in the form of punched long perforations so that the top plate (4) substantially has the characteristics of a grating and sound passes through the perforations into the noise-absorbing plate.

2. The guard rail according to claim 1, the height of the noise-absorbing plate (1) being less than twice the height from the ground in which the plurality of substantially vertical posts are anchored to the top of the longitudinal guard rail beam (2).

3. The guard rail according to claim 1, wherein the noise-absorbing plate (1) includes a noise-reducing material sheathed with a stiff metal net.

4. The guard rail according to claim 1, the longitudinal guard rail beam (2) being unitarily connected to the top plate (4).

5. The guard rail according to claim 1, the longitudinal guard rail beam (2) and the top plate (4) being two separate sectional plates.

6. The guard rail according to claim 1, whereby the perforations of the longitudinal guard rail beam (2) are punched perforations punched in a plate prior to said plate being pressed into the final form of the longitudinal guard rail beam (2).

7. The guard rail according to claim 1, further comprising a second longitudinal guard rail beam positioned on an opposite side of the plurality of substantially vertical posts (3) and parallel to the longitudinal guard rail beam (2).

8. A road system having at least one roadway including at least one guard rail according to claim 1, said at least one guard rail being provided along and in the immediate proximity of the roadway.

9. The guard rail according to claim 1, wherein the longitudinal guard rail beam is a sectional plate beam.

10. The guard rail according to claim 9, wherein the sectional plate beam is a sectional plate beam with an open profile.

11. A guard rail having noise-reducing measures, comprising:

a plurality of substantially vertical posts (3);

a longitudinal guard rail beam (2) supported by the plurality of substantially vertical posts through arms attached to the posts; and a noise-absorbing plate (1) attached to and longitudinally extending between each adjacent pair of the plurality of substantially vertical posts (3) at a rear of the longitudinal guard rail beam and extending substantially the entire height of the vertical posts, the noise-absorbing plate comprising a core of noise-absorbing material, wherein the longitudinal guard rail beam (2) comprises perforations and sound passes through the perforations into the noise-absorbing plate (1), and wherein the noise-reducing measures further comprises a top plate (4) extending substantially the entire length of the longitudinal guard rail beam from the longitudinal guard rail beam to the noise-absorbing plate (1), the top plate being coupled to the longitudinal guard rail beam and the vertical posts, and extending above and covering the arms, the posts and the noise-absorbing plate, wherein the to plate (4) is provided with perforations and sound passes through the perforations into the noise-absorbing plate, and wherein the longitudinal guard rail beam is a sectional plate beam.

12. The guard rail according to claim 11, wherein the sectional plate beam is a sectional plate beam with an open profile.

* * * * *